US008026866B2

(12) United States Patent
Tsai et al.

(10) Patent No.: US 8,026,866 B2
(45) Date of Patent: Sep. 27, 2011

(54) METHOD FOR APPLYING THE SAME DITHERING TABLE TO DIFFERENT FLAT PANELS AND DISPLAY PANEL DRIVING METHOD USING THE SAME

(75) Inventors: Jeng-Luen Tsai, Hsinchu (TW); Wen Yuan Kuo, Hsin Chu (TW)

(73) Assignee: Orise Technology Co., Ltd., Hsinchu (TW)

( * ) Notice: Subject to any disclaimer, the term of this patent is extended or adjusted under 35 U.S.C. 154(b) by 594 days.

(21) Appl. No.: 12/243,203

(22) Filed: Oct. 1, 2008

(65) Prior Publication Data

US 2010/0026708 A1 Feb. 4, 2010

(30) Foreign Application Priority Data

Jul. 30, 2008 (TW) ..... 97128732 A

(51) Int. Cl.
*G09G 5/00* (2006.01)

(52) U.S. Cl. ..... 345/3.1; 345/596

(58) Field of Classification Search ..... 345/3.1–3.4, 345/596–605, 694, 695
See application file for complete search history.

(56) References Cited

U.S. PATENT DOCUMENTS

| | | | | |
|---|---|---|---|---|
| 6,154,225 | A * | 11/2000 | Kou et al. | 345/519 |
| 6,215,459 | B1 * | 4/2001 | Reddy et al. | 345/3.1 |
| 6,252,613 | B1 * | 6/2001 | Borel et al. | 345/531 |
| 6,628,243 | B1 * | 9/2003 | Lyons et al. | 345/1.1 |
| 2005/0073470 | A1 * | 4/2005 | Nose et al. | 345/1.1 |
| 2006/0114513 | A1 * | 6/2006 | Ogawa | 358/3.13 |

* cited by examiner

*Primary Examiner* — Alexander Eisen
*Assistant Examiner* — Amit Chatly
(74) *Attorney, Agent, or Firm* — Muncy, Geissler, Olds & Lowe, PLLC

(57) ABSTRACT

A method for applying the same dithering table to different flat panels and a display panel driving method using the same. The method for applying the same dithering table to different flat panels is mainly to set different dot counts between different panels on the rows, in which pixels are shifted, so that the display data of scan lines, in which the pixels are shifted, is shifted by the dot counts when the display data is substituted into the dithering table. Thus, even if different display panels use the same dithering table, the display entropy can be uniformly distributed.

8 Claims, 6 Drawing Sheets

METHOD FOR APPLYING THE SAME DITHERING TABLE TO DIFFERENT FLAT PANELS AND DISPLAY PANEL DRIVING METHOD USING THE SAME

This application claims priority of No. 097128732 filed in Taiwan R.O.C. on Jul. 30, 2008 under 35 USC 119, the entire content of which is hereby incorporated by reference.

BACKGROUND OF THE INVENTION

1. Field of Invention

The invention relates to a flat panel display driver, and more particularly to a method for applying the same dithering table to different display panels.

2. Related Art

The development of the opto-electronic and semiconductor technology drives the flourishing development of the flat panel display. Among many flat panel displays, a liquid crystal display (LCD) has become the mainstream in the market because it has the superior properties, such as the high spatial utilization efficiency, the low power consumption, no radiation and the low electromagnetic interference. Thus, the LCD has been widely used in electronic products, such as the liquid crystal display of a notebook computer or a desktop computer and the display of a liquid crystal display television (LCD TV), relevant to the life. The driving circuit of the LCD panel is the key component, which influences the quality and the cost of the LCD.

FIG. 1 is a structure diagram showing a parallel matrix LCD panel according to the prior art. As shown in FIG. 1, the transversal red (R), green (G) and blue (B) sub-pixels are defined as one set in the structure of the LCD panel, and the previous row of red (R), green (G) and blue (B) sub-pixels is aligned with the next row of red (R), green (G) and blue (B) sub-pixels. The blue (B) sub-pixels in the first column are the unused pixels and are left when the panel is cut. FIG. 2 is a structure diagram showing a Delta matrix LCD panel according to the prior art. As shown in FIG. 2, the previous row of transversal red (R) sub-pixels and the next row of green (G) and blue (B) sub-pixels are defined as one set in the structure of the LCD panel. The previous transversal green (G) and blue (B) sub-pixels and the next row of red (R) sub-pixels are defined as one set. Th sub-pixels (R), (G) and (B) of each set of the sub-pixels are arranged to form the Delta, so the panel is also referred to as a Delta architecture panel. Similarly, the sub-pixels in the first column are the unused pixels and are left when the panel is cut.

In addition, the gray scale levels that can be displayed by the low-cost panel are only equal to 6 bits and are thus equal to 64 gray scale levels in the present driver of the LCD panel. So, the dithering algorithms are often used in the driver, wherein the dithering algorithms are divided into the time dithering algorithm and the spatial dithering algorithm. The spatial dithering algorithm is to simulate 256 gray scale levels using four pixels of 64 gray scale levels. For example, when the gray-scale data is 201, four pixels respectively display 50, 50, 50 and 51 to simulate the gray scale level, which has the brightness of 201 when being viewed by the human eyes. The time dithering algorithm is to divide the time into four sectors and to simulate the 256 gray scale levels using one pixel with 64 gray scale levels. For example, when the gray-scale data is 201, the gray scale levels of 50, 50, 50 and 51 are respectively displayed during the first time sector, the second time sector, the third time sector and the fourth time sector to simulate the gray scale level, which has the brightness of 201 when being viewed by the human eyes.

No matter which dithering algorithm is used, a dithering table is built in the LCD panel driver according to the present technology. Generally speaking, the dithering table is a M×N matrix having elements each serving as a dithering operator. In order to briefly describe the operating principle of the dithering table applied to the LCD panel driver, it is assumed that the dithering table is a 3×3 matrix and that the LCD panel to be driven is a parallel matrix LCD panel. When the LCD panel is to be driven, the first row of RGB sub-pixels is substituted into the first row of the dithering table, the second row of RGB sub-pixels is substituted into the second row of the dithering table, and the third row of RGB pixels is substituted into the third row of the dithering table. Next, the first row of second set of RGB sub-pixels is substituted into the first row of the dithering table, the second row of second set of RGB sub-pixels is substituted into the second row of the dithering table, the third row of second set of RGB sub-pixels is substituted into the third row of the dithering table, and so on. The color data is substituted into the dithering table according to the order of driving the pixels so that the driving values are obtained, and then the LCD panel is driven according to the driving values.

Next, as shown in FIGS. 1 and 2, the order of the dots of the even numbered scan lines on the Delta architecture panel is GBR, and the order of the dots of even numbered scan lines on the parallel matrix LCD panel is RGB. If the same dithering table is used according to the description mentioned hereinabove, the phenomenon that the even numbered scan lines are shifted by one dot occurs in the displayed effect. In order to make the phenomenon be more clearly understood, two examples will be described in the following.

FIG. 3 is a schematic illustration showing the pattern entropy, which is displayed after the display data of the conventional parallel matrix LCD panel is substituted into the dithering table and after the display data of the conventional Delta matrix LCD panel is substituted into the dithering table. As shown in FIG. 3, symbol 301 represents the pattern entropy distribution displayed when the display data of the parallel matrix LCD panel is substituted into the dithering table, and symbol 302 represents the pattern entropy distribution displayed when the display data of the Delta matrix LCD panel is substituted into the dithering table. As shown in FIG. 3, the dot data of the even numbered scan lines of the original parallel matrix LCD panel to be firstly dithered is red (R) pixel data, but the dot data of the even numbered scan lines of the original Delta matrix LCD panel to be firstly dithered is blue (B) pixel data. Thus, if two panels share the same dithering table, one of the display panels has the worse entropy distribution. In this example, it is found, from the displayed effect, that the entropy 302 on the right-hand side is worse than the entropy 301 on the left-hand side. In addition, the user sees the striped fine noise on the right displayed frame in practice.

FIG. 4 is a schematic illustration showing the pattern entropy, which is displayed after the conventional green display data of the conventional parallel matrix LCD panel is substituted into the dithering table and after the green display data of the conventional Delta matrix LCD panel is substituted into the dithering table. As shown in FIG. 4, when only the pure color, such as the green (G) color, is displayed, the nonuniform phenomenon of the entropy becomes more obvious on the Delta matrix LCD panel.

However, the economic effectiveness cannot be satisfied if the LCD panel driving circuit is modified only for the purpose of the applications to different panels. Thus, it is necessary to provide the method for applying the same dithering table to different display panels and the method for sharing the same dithering table.

SUMMARY OF THE INVENTION

It is therefore an objective of the invention to provide a method for applying the same dithering table and a display panel driving method so that a dithering table built in a display driving circuit may be applied to at least two display panels.

To achieve the above-identified or other objectives, the invention provides a method for applying the same dithering table to a first display panel and a second display panel. The first display panel includes a plurality of pixels, which includes K colors numbered as 1 to K. The second display panel includes a plurality of pixels, which includes K colors numbered as 1 to K. The dithering table includes M×N dithering operators. The pixels in each of rows of each of the first display panel and the second display panel are arranged in a cyclic order of the first color pixel→the second color pixel→ . . . the $K^{th}$ color pixel→the first color pixel . . . , and the colors of the $i^{th}$ row of the first pixels of the first display panel are different from the colors of the $i^{th}$ row of the first pixels of the second display panel. The method for applying the same dithering table includes the steps of: providing a dot count p, wherein the dot count p is an absolute value of a difference between the color number of the $i^{th}$ row, $j^{th}$ column of pixel of the first display panel and the color number of the $i^{th}$ row, $j^{th}$ column of pixel of the second display panel; and substituting the first 1 to $(M-p)^{th}$ pixels into the $(p+1)^{th}$ to $M^{th}$ dithering operators of the $q^{th}$ row of the dithering table, and then substituting the $(r\times M-p+1)^{th}$ to the $((r+1)\times M-p)^{th}$ pixels into the first to $M^{th}$ dithering operators of the $q^{th}$ row of the dithering table when the $i^{th}$ row of pixel data of the second display panel is dithered, wherein K, M, N, i, j, p and r are natural numbers, and $0<p<M$, $0<q\leqq N$, $r>0$ and $M\geqq K$.

The invention also discloses a display panel driving method adapted to a first display panel and a second display panel. The first display panel includes a plurality of pixels, which includes K colors numbered as 1 to K. The second display panel includes a plurality of pixels, which includes K colors numbered as 1 to K. The pixels in each of rows of each of the first display panel and the second display panel are arranged in a cyclic order of the first color pixel→the second color pixel→ . . . the $K^{th}$ color pixel→the first color pixel . . . , and the colors of the $i^{th}$ row of the first pixels of the first display panel are different from the colors of the $i^{th}$ row of the first pixels of the second display panel. The display panel driving method includes the steps of: providing a dithering table, which comprises M×N dithering operators; providing a dot count p, wherein the dot count p is an absolute value of a difference between the color number of the $i^{th}$ row, $j^{th}$ column of pixel of the first display panel and the color number of the $j^{th}$ row, $j^{th}$ column of pixel of the second display panel; substituting the first 1 to $(M-p)^{th}$ pixels into the $(p+1)^{th}$ to $M^{th}$ dithering operators of the $q^{th}$ row of the dithering table, and then substituting the $(r\times M-p+1)^{th}$ to the $((r+1)\times M-p)^{th}$ pixels into first to $M^{th}$ dithering operators of the $q^{th}$ row of the dithering table when the $i^{th}$ row of pixel data of the second display panel is dithered; and converting the pixel data, obtained after the above-mentioned step, into an analog driving signal to drive the second display panel, wherein K, M, N, i, j, p and r are natural numbers, $0<p<M$, $0<q\leqq N$, $r>0$, and $M\geqq K$.

In the method for applying the same dithering table for different flat panels and a display panel driving method using the same, the first display panel is a parallel matrix LCD panel, the second display panel is a Delta matrix LCD panel, and each of the first display panel and the second display panel includes three colors of pixels, which are respectively red, green and blue colors of pixels, and the red, green and blue colors are respectively numbered as 1, 2 and 3.

The spirit of the invention is to set different dot counts between different panels on the rows, in which pixels are shifted, so that the display data of scan lines, in which the pixels are shifted, is shifted by the dot counts when the display data is substituted into the dithering table. Thus, even if different display panels use the same dithering table, the display entropy can be uniformly distributed. Also, even if the panel structures are different from each other, the same display panel driving circuit may be shared without additionally designing the driving circuits for different display panels by the manufacturer.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

DETAILED DESCRIPTION OF THE INVENTION

The present invention will be apparent from the following detailed description, which proceeds with reference to the accompanying drawings, wherein the same references relate to the same elements.

Figure 1:
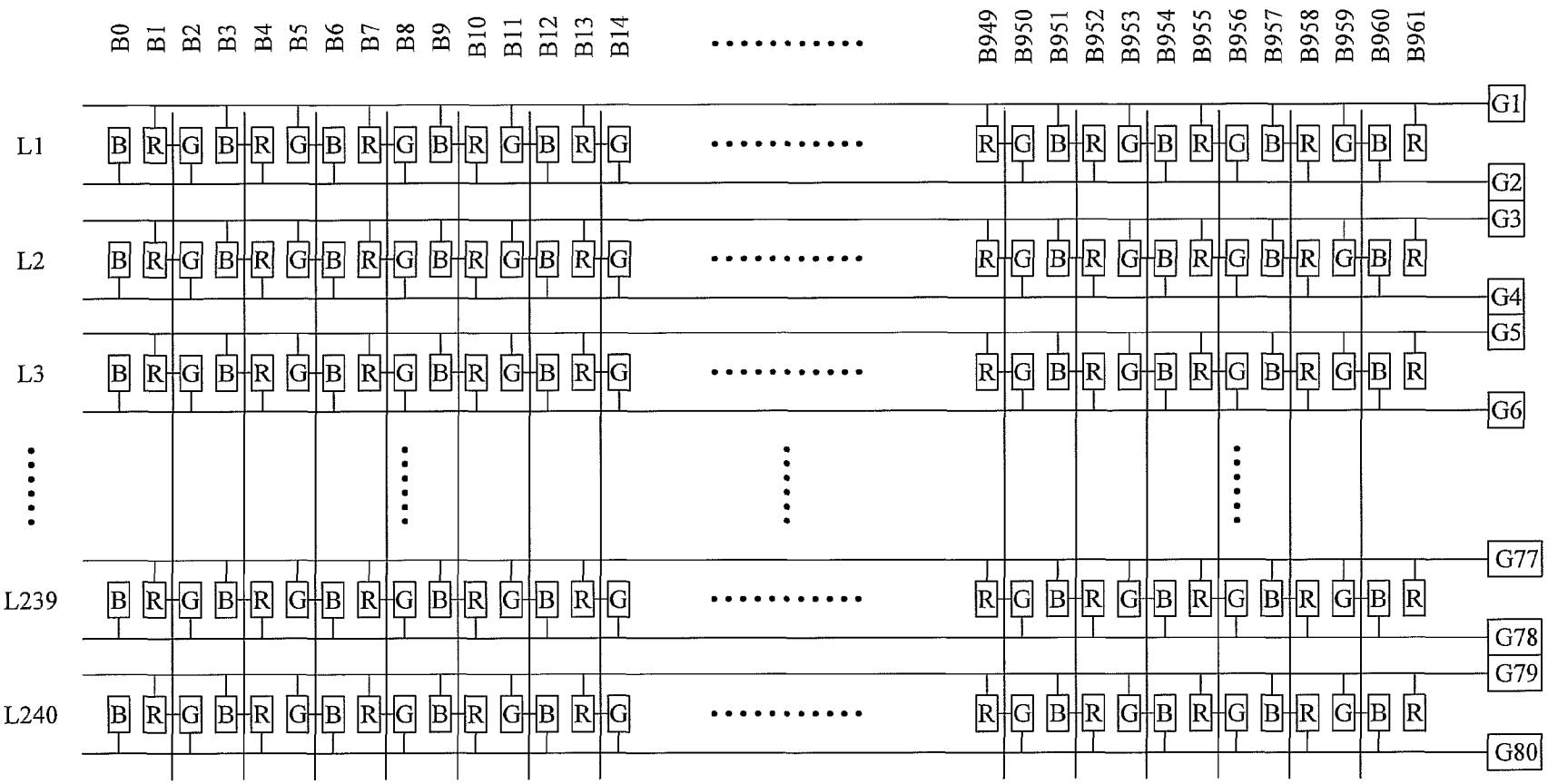
FIG. 1 (Prior Art)
FIG. 1 is a structure diagram showing a parallel matrix LCD panel according to the prior art.
Figure 2:
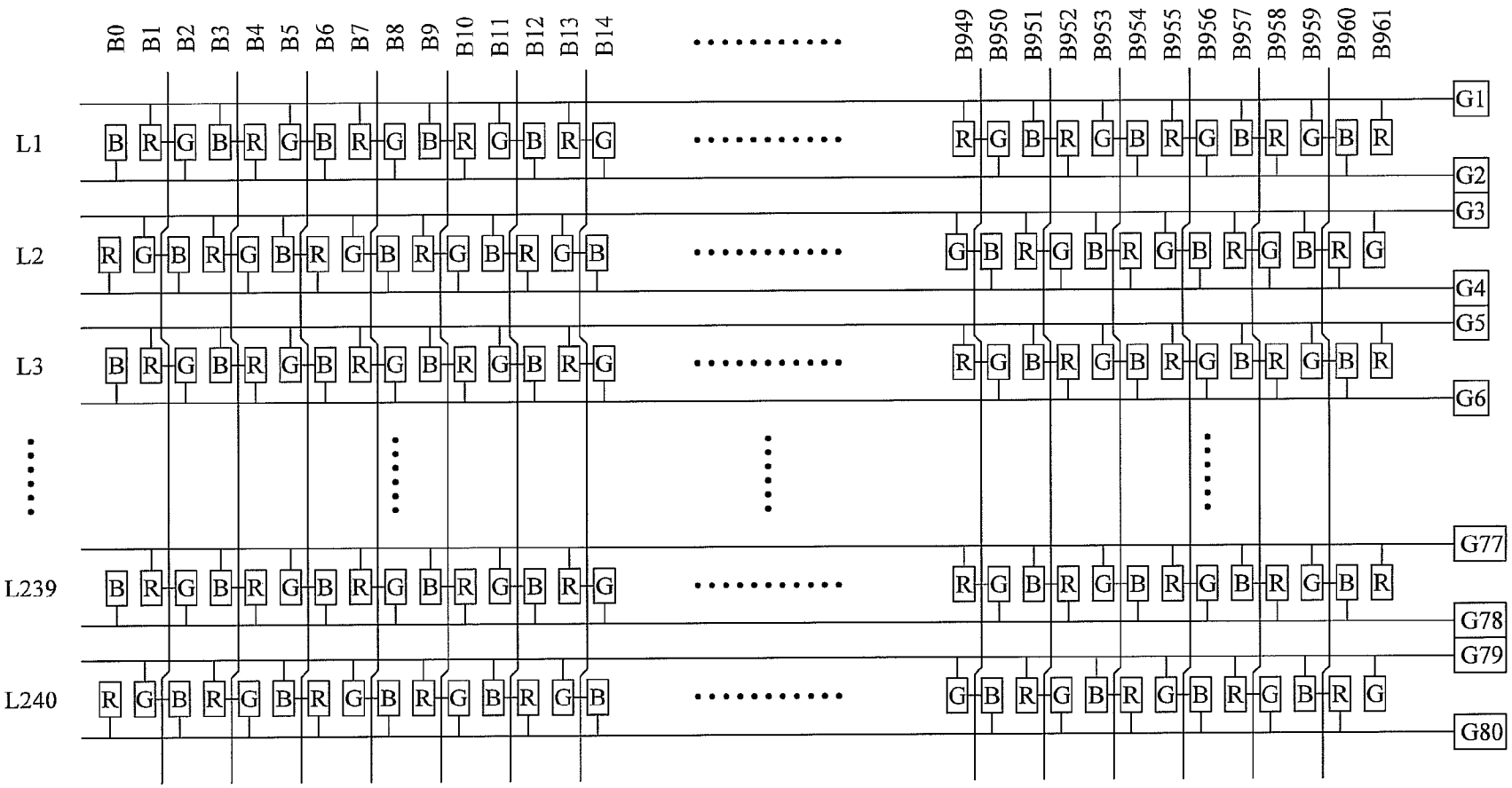
FIG. 2 (Prior Art)
FIG. 2 is a structure diagram showing a Delta matrix LCD panel according to the prior art.
Figure 3:
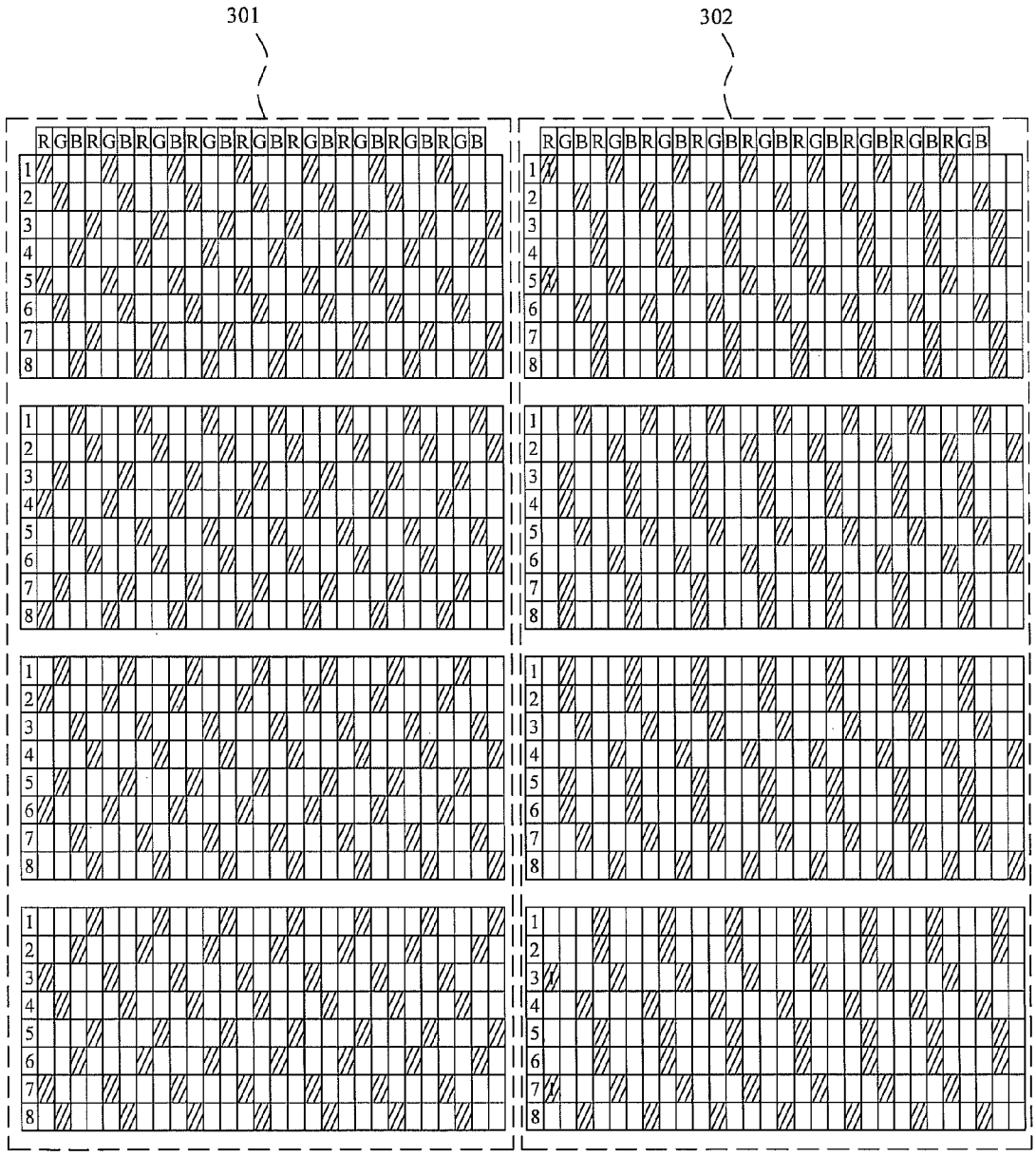
FIG. 3 (Prior Art)
FIG. 3 is a schematic illustration showing the pattern entropy, which is displayed after the display data of the conventional parallel matrix LCD panel is substituted into the dithering table and after the display data of the conventional Delta matrix LCD panel is substituted into the dithering table.
Figure 4:
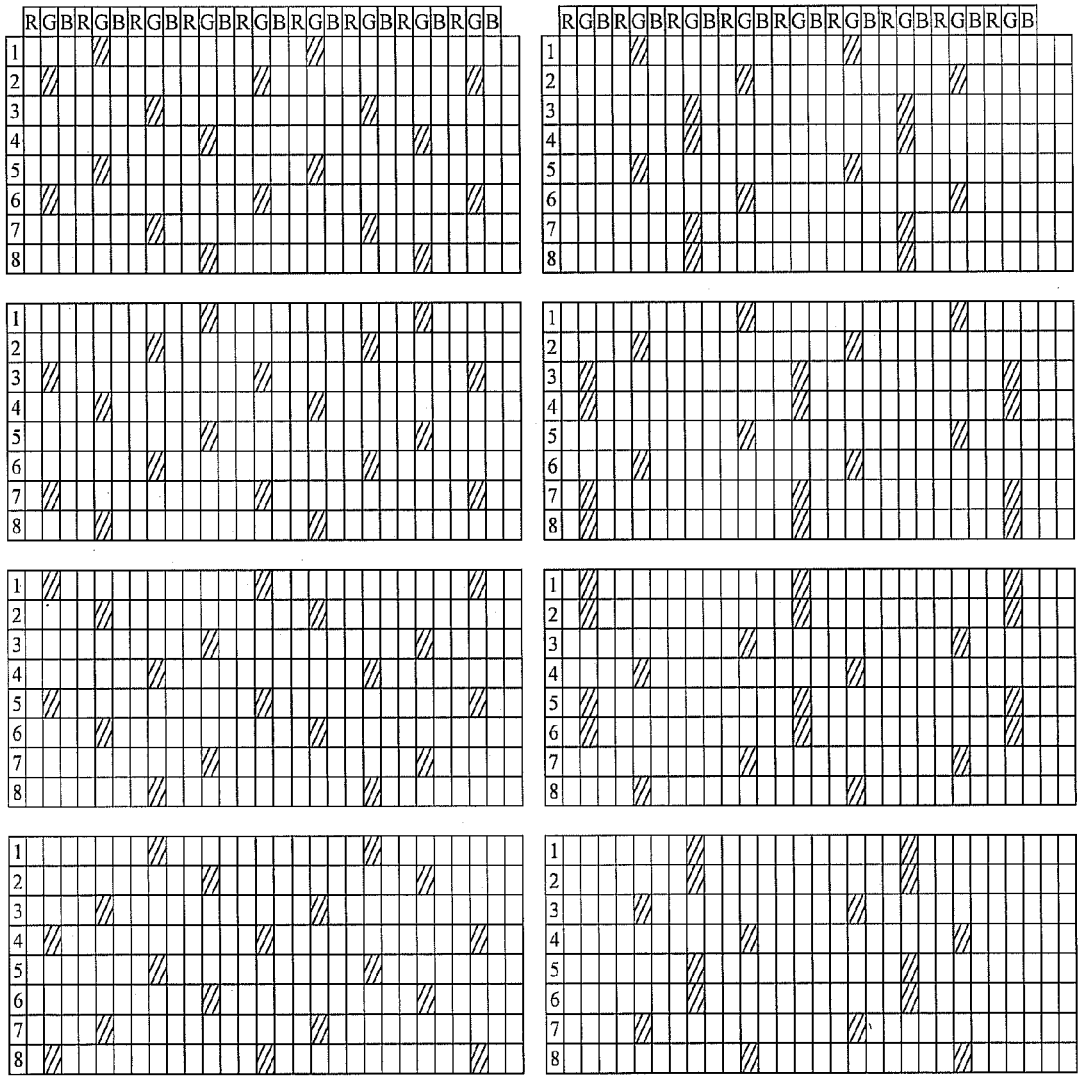
FIG. 4 is a schematic illustration showing the pattern entropy, which is displayed after the conventional green display data of the conventional parallel matrix LCD panel is substituted into the dithering table and after the green display data of the conventional Delta matrix LCD panel is substituted into the dithering table.
Figure 5:
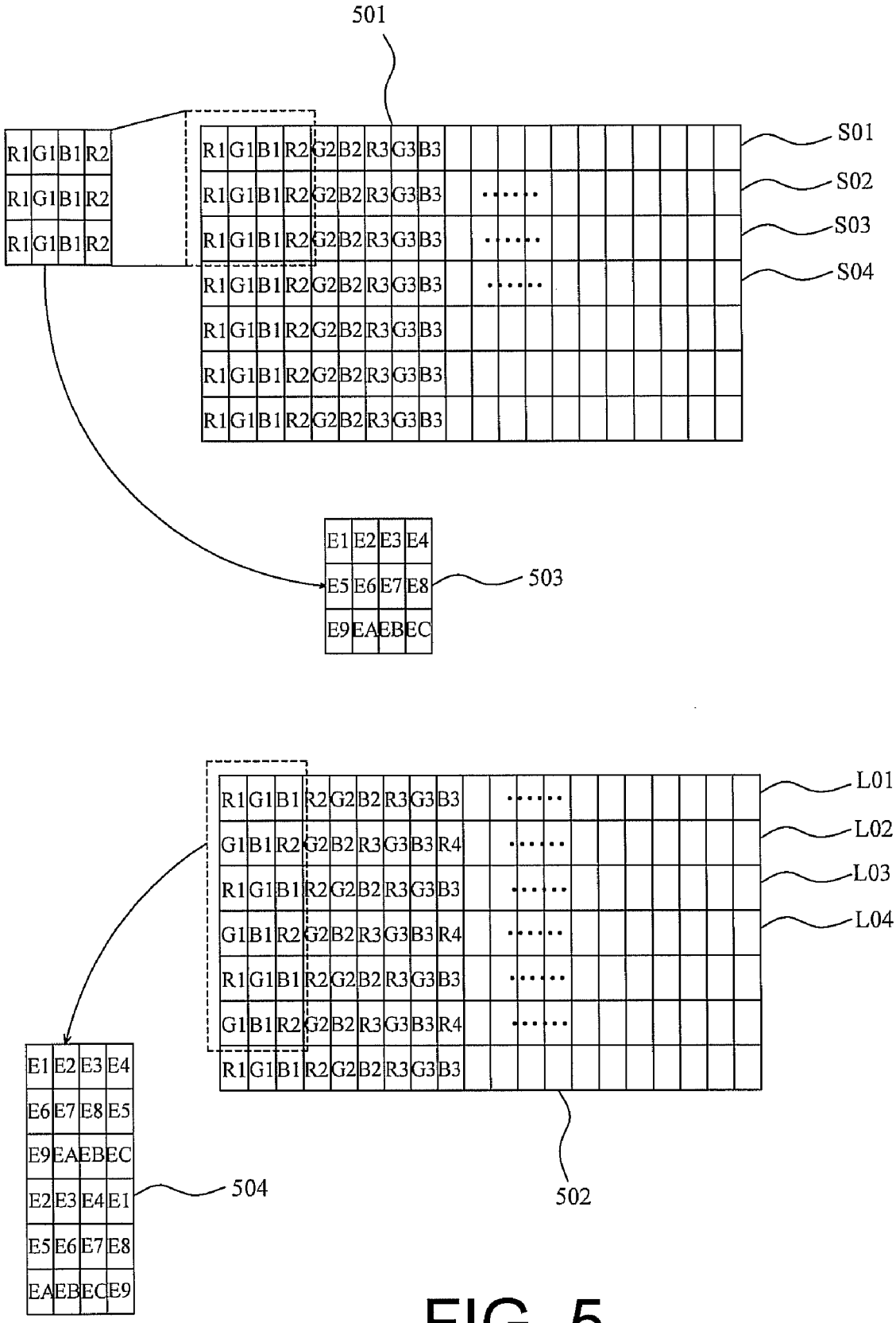
FIG. 5 is a schematic illustration showing a display panel driving method according to the embodiment of the invention.

FIG. 5 is a schematic illustration showing a display panel driving method according to the embodiment of the invention. As shown in FIG. 5, it is firstly assumed that two display panels 501 and 502 are respectively the parallel matrix LCD panel 501 of FIG. 1 and the Delta matrix LCD panel 502 of FIG. 2 before the method is described. In addition, each color is defined to have a color number, wherein the color number of the red (R) is 1, the color number of the green (G) is 2 and the color number of the blue (B) is 3. In addition, a dithering table 503 having 4×4 dithering operators is defined. As shown in the drawing, the pixels of the parallel matrix LCD panel 501 and the Delta matrix LCD panel 502 are arranged in the cyclic order of (R) pixel→(G) pixel→(B) pixel→(R) pixel . . . , but the initial pixels are different in the pixel arrangement of the even numbered scan lines of the LCD panels 501 and 502. The first pixel of the even numbered scan lines of the LCD panel 501 is the green (G) pixel, but the first pixel of the even numbered scan lines of the LCD panel 502 is the red (R) pixel.

In addition, it is further assumed that the dithering table 503 is mainly designed according to the LCD panel 501. Thus, when the dithering table 503 is applied to the driving of the LCD panel 501, its corresponding display data only has to be substituted into the dithering table 503 according to the order. In this method, one dot counter is utilized in the design of the driving circuit to accumulate a dot count. When the number is accumulated by 1, one piece of pixel data is substituted into the table. When the dot count is 0, the data R1 of the first scan line S01 is substituted into the operator E1;→when the dot count is 1, the data G1 is substituted into the operator E2;→when the dot count is 2, the data B1 is substituted into the operator E3; →when the dot count is 3, the data R2 is substituted into the operator E4;→when the dot count is 0, the data G2 is substituted into the operator E1;→ . . . , and so one. Next, when the dot count is 0, the data R1 of the second scan line S02 is substituted into the operator E5;→when the dot count is 1, the data G1 is substituted into the operator E6;→when the dot count is 2, the data B1 is substituted into the operator E7;→when the dot count is 3, the data R2 is substituted into the operator E8;→when the dot count is 0, the data G2 is substituted into the operator E5;→ . . . , and the so on. Similarly, when the dot count is 0, the data R1 of the third scan line S03 is substituted into the operator E9;→when the dot count is 1, the data G1 is substituted into the operator EA;→when the dot count is 2, the data B1 is substituted into the operator EB;→when the dot count is 3, the data R2 is substituted into the operator EC;→when the dot count is 0, the data G2 is substituted into the operator E9;→ . . . , and so on.

However, when the dithering table 503 is applied to the driving of the LCD panel 502, the dithering table 503 has to be theoretically modified into a new dithering table 504. However, the dithering table 503 needs not to be modified in this embodiment. The color arranging orders of the even numbered scan lines of the LCD panel 502 and the even numbered scan lines of the LCD panel 501 are the same except that the initial pixel colors are different. According to the color numbers defined hereinabove, the differences between the color numbers of the pixels of the even numbered scan lines on the LCD panel 502 and the LCD panel 501 are equal to 1. For example, the first pixel of the even numbered scan lines on the LCD panel 502 is the green (G) pixel and is numbered as 2, and the first pixel of the even numbered scan lines on the LCD panel 501 is the red (R) pixel numbered as 1. So, the absolute value of the difference of the color numbers is equal to 1. Thus, when being substituted into the even numbered scan lines, it is only necessary to set the initial value of the dot count to be the above-mentioned difference.

Taking the second scan line L02 of the LCD panel 502 as an example, the order of substituting is changed as follows because the initial value of the dot count is set to be 1: G1 is substituted into the operator E6;→when the dot count is 2, the data B1 is substituted into the operator E7;→when the dot count is 3, the data R2 is substituted into the operator E8;→when the dot count is reset to 0, the data G2 is substituted into the operator E5;→when the dot count is 1, the data B2 is substituted into the operator E6;→ . . . , and so one. Similarly, taking the fourth scan line L04 of the LCD panel 502 as an example, the order of substituting is changed as follows because the initial value of the dot count is set to be 1: G1 is substituted into the operator E2;→when the dot count is 2, the data B1 is substituted into the operator E3;→when the dot count is 3, the data R2 is substituted into the operator E4;→when the dot count is reset to 0, the data G2 is substituted into the operator E1;→when the dot count is 1, the data B2 is substituted into the operator E2;→ . . . , and so on. Thus, the same dithering table 503 can be shared without being modified. In addition, the conventional striped fine noise can be eliminated.

Figure 6:
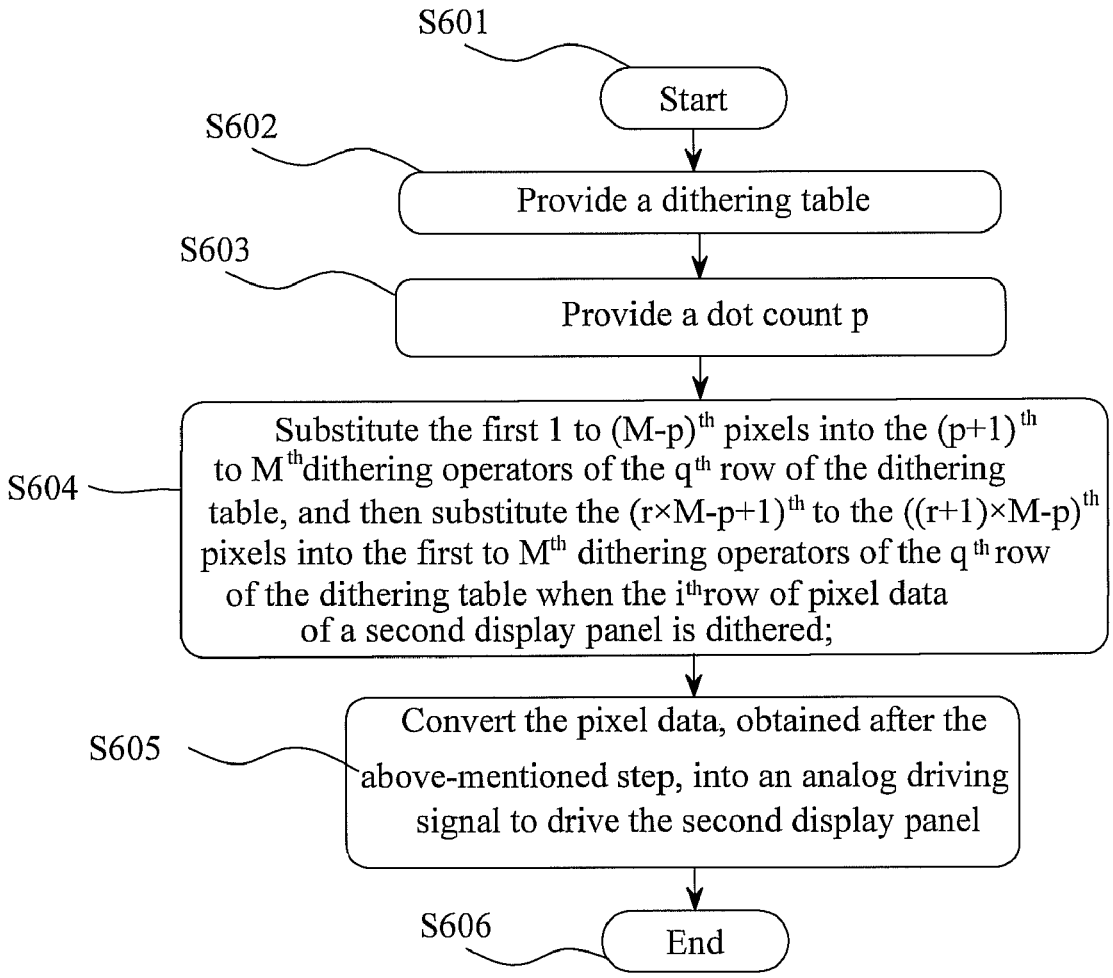
FIG. 6 is a flow chart showing the display panel driving method according to the embodiment of the invention.

A display panel driving method may be concluded according to the above-mentioned embodiment. This method may drive the first display panel and the second display panel. The pixels in each row of each of first display panel and the second display panel are arranged in the cyclic order of the first color of pixel→the second color of pixel→ . . . the $K^{th}$ color of pixel→the first color of pixel, and the color of the first pixel of the $i^{th}$ row of the first display panel is different from the color of the first pixel of the $i^{th}$ row of the second display panel. FIG. 6 is a flow chart showing the display panel driving method according to the embodiment of the invention. Referring to FIG. 6, the method includes the following steps.

In step S601, the method starts.

In step S602, a dithering table including M×N dithering operators is provided.

In step S603, a dot count p is provided. The dot count p is an absolute value of a difference between the color number of the $i^{th}$ row, $j^{th}$ column of pixel of the first display panel and the color number of the $i^{th}$ row, $j^{th}$ column of pixel of the second display panel. In the above-mentioned embodiment, the difference between the color number of the first pixel R of the second row of the LCD panel 501 and the color number of the first pixel G of the second row of the LCD panel 502 is illustrated as an example. However, one of ordinary skill in the art may understand that the differences between the color numbers of the same row, the same column of pixel should be the same.

In step S604, when the $i^{th}$ row of pixel data of the second display panel is being dithered, the first 1 to $(M-p)^{th}$ pixels are substituted into the $(p+1)^{th}$ to $M^{th}$ dithering operators of the $q^{th}$ row of the dithering table, and then the $(r\times M-p+1)^{th}$ to the $((r+1)\times M-p)^{th}$ pixels are substituted into the first to $M^{th}$ dithering operators of the $q^{th}$ row of the dithering table, wherein K, M, N, i, j, p and r are natural numbers, and $0<p<M$, $0<q\leqq N$. $r>0$, and $M\geqq K$. In the above-mentioned embodiment, M is equal to 4, p is equal to 1, and the result of the above-mentioned embodiment may be obtained after being substituted into the above-mentioned step.

In step S605, the pixel data, obtained after the above-mentioned step, is converted into an analog driving signal to drive the second display panel.

In step S606, the method ends.

In summary, the spirit of the invention is to set different dot counts between different panels on the rows, in which pixels are shifted, so that the display data of scan lines, in which the pixels are shifted, is shifted by the dot counts when the display data is substituted into the dithering table. Thus, even if different display panels use the same dithering table, the display entropy can be uniformly distributed. Also, even if the panel structures are different from each other, the same display panel driving circuit may be shared without additionally designing the driving circuits for different display panels by the manufacturer.

While the invention has been described by way of examples and in terms of preferred embodiments, it is to be understood that the invention is not limited thereto. To the contrary, it is intended to cover various modifications. Therefore, the scope of the appended claims should be accorded the broadest interpretation so as to encompass all such modifications.

What is claimed is:

1. A method for applying the same dithering table to a first display panel and a second display panel, wherein:

the first display panel comprises a plurality of pixels, which comprises K colors numbered as 1 to K;

the second display panel comprises a plurality of pixels, which comprises K colors numbered as 1 to K; and the dithering table comprises M×N dithering operators, wherein the pixels in each of rows of each of the first display panel and the second display panel are arranged in a cyclic order of the first color pixel→the second color pixel→ . . . the $K^{th}$ color pixel →the first color pixel . . . , and the colors of the $i^{th}$ row of the first pixels of the first display panel are different from the colors of the $i^{th}$ row of the first pixels of the second display panel, the method for applying the same dithering table comprising the steps of:

providing a dot count p, wherein the dot count p is an absolute value of a difference between the color number of the $i^{th}$ row, $j^{th}$ column of pixel of the first display panel and the color number of the $i^{th}$ row, $j^{th}$ column of pixel of the second display panel; and substituting the first 1 to $(M-p)^{th}$ pixels into the $(p+1)^{th}$ to $M^{th}$ dithering operators of the $q^{th}$ row of the dithering table, and then substituting the $(r\times M-p+1)^{th}$ to the $((r+1)\times M-p)^{th}$ pixels into the first to $M^{th}$ dithering operators of the $q^{th}$ row of the dithering table when the $i^{th}$ row of pixel data of the second display panel is dithered, wherein K, M, N, i, j, p and r are natural numbers, and $0<p<M$, $0<q\leqq N$, $r>0$ and $M\geqq K$.

2. The method according to claim 1, wherein the first display panel is a parallel matrix LCD panel.

3. The method according to claim 1, wherein each of the first display panel and the second display panel comprises three colors of pixels, which are respectively red, green and blue colors of pixels, and the red, green and blue colors are respectively numbered as 1, 2 and 3.

4. The method according to claim 1, wherein the second display panel is a Delta matrix LCD panel.

5. A display panel driving method adapted to a first display panel and a second display panel, wherein:

the first display panel comprises a plurality of pixels, which comprises K colors numbered as 1 to K;

the second display panel comprises a plurality of pixels, which comprises K colors numbered as 1 to K, and wherein the pixels in each of rows of each of the first display panel and the second display panel are arranged in a cyclic order of the first color pixel→the second color pixel→ . . . the $K^{th}$ color pixel →the first color pixel . . . , and the colors of the $i^{th}$ row of the first pixels of the first display panel are different from the colors of the $i^{th}$ row of the first pixels of the second display panel, the display panel driving method comprising the steps of:

providing a dithering table, which comprises M×N dithering operators;

providing a dot count p, wherein the dot count p is an absolute value of a difference between the color number of the $i^{th}$ row, $j^{th}$ column of pixel of the first display panel and the color number of the $i^{th}$ row, $j^{th}$ column of pixel of the second display panel;

substituting the first 1 to $(M-p)^{th}$ pixels into the $(p+1)^{th}$ to $M^{th}$ dithering operators of the $q^{th}$ row of the dithering table, and then substituting the $(r\times M-p+1)^{th}$ to the $((r+1)\times M-p)^{th}$ pixels into the first to $M^{th}$ dithering operators of the $q^{th}$ row of the dithering table when the $i^{th}$ row of pixel data of the second display panel is dithered; and converting the pixel data, obtained after the above-mentioned step, into an analog driving signal to drive the second display panel, wherein K, M, N, i, j, p and r are natural numbers, $0<p<M$, $0<q\leqq N$, $r>0$, and $M\geqq K$.

6. The method according to claim 5, wherein the first display panel is a parallel matrix LCD panel.

7. The method according to claim 5, wherein each of the first display panel and the second display panel comprises three colors of pixels, which are respectively red, green and blue colors of pixels, and the red, green and blue colors are respectively numbered as 1, 2 and 3.

8. The method according to claim 5, wherein the second display panel is a Delta matrix LCD panel.

* * * * *